US011808441B2

(12) United States Patent
Kuo

(10) Patent No.: US 11,808,441 B2
(45) Date of Patent: Nov. 7, 2023

(54) ELECTRONIC DEVICE HOUSING WITH INDICATING LIGHT RING

(71) Applicant: Wistron NeWeb Corp., Hsinchu (TW)

(72) Inventor: Chih-Chun Kuo, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 17/744,898

(22) Filed: May 16, 2022

(65) Prior Publication Data

US 2022/0381427 A1 Dec. 1, 2022

(30) Foreign Application Priority Data

May 25, 2021 (TW) ..... 110118801

(51) Int. Cl.

| | |
|---|---|
| ***F21K 9/61*** | (2016.01) |
| ***F21V 23/00*** | (2015.01) |
| ***F21V 23/04*** | (2006.01) |
| *F21Y 109/00* | (2016.01) |
| *E05B 17/10* | (2006.01) |
| *F21W 111/10* | (2006.01) |

(52) U.S. Cl.

CPC ..... *F21V 23/004* (2013.01); *F21V 23/04* (2013.01); *E05B 17/10* (2013.01); *F21W 2111/10* (2013.01); *F21Y 2109/00* (2016.08)

(58) Field of Classification Search

CPC ..... F21K 9/61; F21V 2200/13; F21V 23/004; G02B 6/0095; G02B 6/0073; H01H 13/023; H01H 2013/026

See application file for complete search history.

(56) References Cited

U.S. PATENT DOCUMENTS

| | | | | |
|---|---|---|---|---|
| 6,224,221 | B1 * | 5/2001 | Glienicke | G02B 6/0033 116/286 |
| 6,350,039 | B1 * | 2/2002 | Lee | H01H 9/181 362/147 |
| 8,550,653 | B2 * | 10/2013 | Wilson | F21V 23/06 362/183 |
| 8,556,456 | B2 * | 10/2013 | Boonekamp | F21K 9/61 362/329 |
| 8,890,844 | B2 * | 11/2014 | Hung | G06F 3/042 345/166 |
| 9,746,154 | B2 * | 8/2017 | Dong | F21V 29/83 |
| 9,930,444 | B1 * | 3/2018 | Stanley | F21V 3/00 |
| 10,631,071 | B2 * | 4/2020 | Wu | H04R 9/06 |
| 11,212,494 | B2 * | 12/2021 | Yanez | H04R 1/403 |
| 11,346,542 | B2 * | 5/2022 | Keresztes | F21V 23/0485 |
| 2008/0285301 | A1 * | 11/2008 | Wanninger | F21S 43/245 362/555 |

(Continued)

*Primary Examiner* — Ismael Negron

(74) *Attorney, Agent, or Firm* — McClure, Qualey & Rodack, LLP

(57) ABSTRACT

An electronic device includes a housing defining a recess and having a bottom wall, a circuit board disposed in the recess, a plurality of first light sources disposed on the circuit board, a guiding ring provided in the housing and extending from the recess to an exterior of the housing, and a plurality of light-absorbing elements. The guiding ring having a light-entering edge for receiving light from the first light sources, and a light-emitting edge for outputting such light; the light-absorbing elements are supported by the bottom wall and adjacent to the light-entering edge.

12 Claims, 7 Drawing Sheets

(56) References Cited

U.S. PATENT DOCUMENTS

2011/0291560 A1* 12/2011 Wang ..... F21K 9/232
315/32
2013/0155719 A1* 6/2013 Brott ..... F21K 9/61
362/609

* cited by examiner

E|

ELECTRONIC DEVICE HOUSING WITH INDICATING LIGHT RING

CROSS REFERENCE TO RELATED APPLICATIONS

This Application claims priority of Taiwan Patent Application No. 110118801, filed on May 25, 2021, the entirety of which is incorporated by reference herein.

BACKGROUND OF THE INVENTION

Field of the Invention

The present invention relates to an electronic device, and in particular to an electronic device with light indication functionality.

Description of the Related Art

Electronic door locks usually come equipped with light indication functionality. The user therefore can find the electronic door lock in a low-light environment. Such electronic door locks can also indicate whether they are locked or unlocked via different lights. Conventionally, the light inside the housing of an electronic door lock is guided by a guiding ring, and is emitted out of the housing. However, from some particular viewing angles, the user can observe that there are light spots on the guiding ring, and the visual perception of user is compromised.

BRIEF SUMMARY OF THE INVENTION

Embodiments of the invention are provided to address the aforementioned difficulty.

In one embodiment, an electronic device with light indication functionality is provided. The electronic device includes a device housing, a circuit board, a guiding ring and a plurality of light-absorbing elements. The device housing includes a housing recess and a supporting member, wherein the supporting member is formed as the bottom of the housing recess. The circuit board is disposed in the housing recess, wherein the circuit board comprises a first circuit board surface and a plurality of first light sources, the first light sources are disposed on the first circuit board surface, and the first light sources provide first light beams. The guiding ring is disposed on the device housing, wherein the guiding ring extends from the housing recess to the exterior of the device housing. The guiding ring has a light-entering edge and a light-emitting edge. The first light beams enter the guiding ring via the light-entering edge, and leave the guiding ring via the light-emitting edge. The light-absorbing elements are supported by the supporting member and correspond to the light-entering edge.

In one embodiment, at least a portion of the light-entering edge is located between the light-absorbing element and the circuit board.

In one embodiment, the device housing comprises a housing outer surface and an annular rib, the annular rib is formed on the housing outer surface, and the light-emitting edge abuts the annular rib.

In one embodiment, the electronic device further comprises a decoration plate, wherein the decoration plate covers the circuit board, and the light-emitting edge surrounds the decoration plate.

In one embodiment, the light-entering edge comprises a plurality of concave portions and a plurality of convex portions, the concave portions and the convex portions are arranged in a staggered manner, the first light sources correspond to the concave portions, and the light-absorbing elements correspond to the concave portions.

In one embodiment, each concave portion has a first sidewall and a second sidewall, an included angle is formed between the first sidewall and the second sidewall, and the included angle is between 100 degrees and 120 degrees.

In one embodiment, the electronic device further comprises a reflective layer, wherein at least a portion of each first light source is located between the reflective layer and the circuit board.

In one embodiment, the first light sources are annular arranged, and the first light sources face the center of the housing recess, and provide the first light beams.

In one embodiment, the electronic device further comprises a decoration plate and a button light guide, wherein the decoration plate covers the circuit board, the decoration plate comprises a button area, the circuit board comprises a second circuit board surface and a plurality of second light sources, the second light sources are disposed on the second circuit board surface, the second circuit board surface is opposite to the first circuit board surface, the button light guide is disposed between the button area and the circuit board, the second light sources face the button light guide and provide second light beams, and the second light beams enter the button light guide and illuminate the button area.

In one embodiment, the electronic device further comprises a first shielding ring, the first shielding ring is disposed on the second circuit board surface, and the first shielding ring separates the button light guide and the guiding ring.

In one embodiment, the electronic device further comprises at least one third light source, a light guiding element and a translucent bar, the device housing comprises a housing slot, the translucent bar is disposed in the housing slot, the third light source provides a third light beam, and the third light beam passes through the light guiding element, and is emitted from the translucent bar.

In one embodiment, the electronic device further comprises a second shielding ring, wherein the third light source is disposed on the first circuit board surface, and the second shielding ring surrounds the third light source.

In one embodiment, the supporting member has a member through hole, a first member surface and a second member surface, the first member surface faces the circuit board, the second member surface is opposite to the first member surface, the third light source corresponds to the member through hole, the light guiding element is disposed on the second member surface and corresponds to the member through hole.

In the embodiment of the invention, the light-absorbing elements correspond to the light-entering edge of the guiding ring. Therefore, the light beam is prevented from directly passing through the guiding ring after reflected by the reflective layer, the light spots of the guiding ring are reduced, and the visual perception of user is improved. Additionally, the first shielding ring separates the first light beams and the second light beams, and the first light beams are prevented from mixed with the second light beams. The second shielding ring separates the first light beams and the third light beam, and the first light beams are prevented from mixed with the third light beam.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
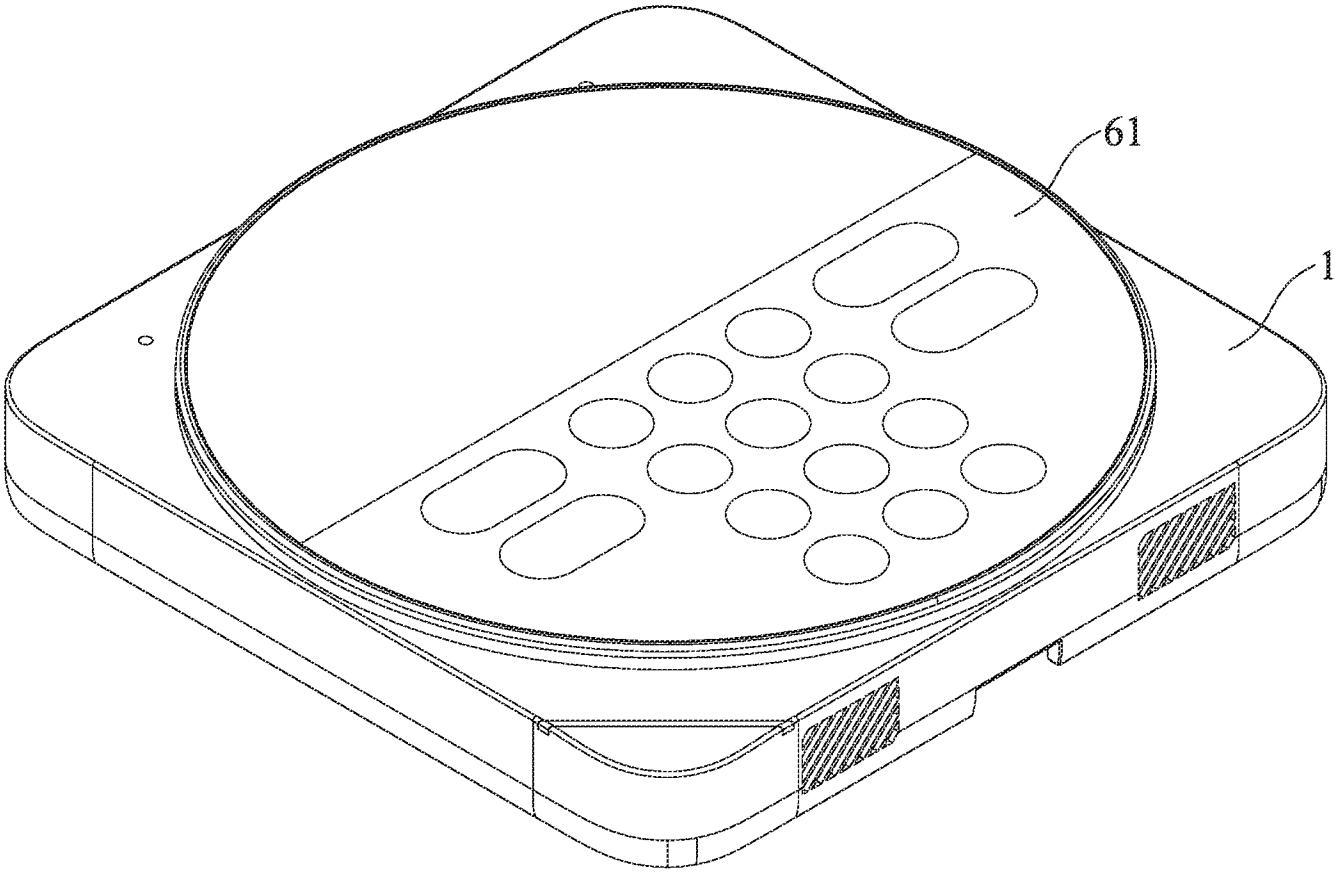
FIG. 1 is a perspective view of an electronic device with light indication functionality of the embodiment of the invention.
Figure 2:
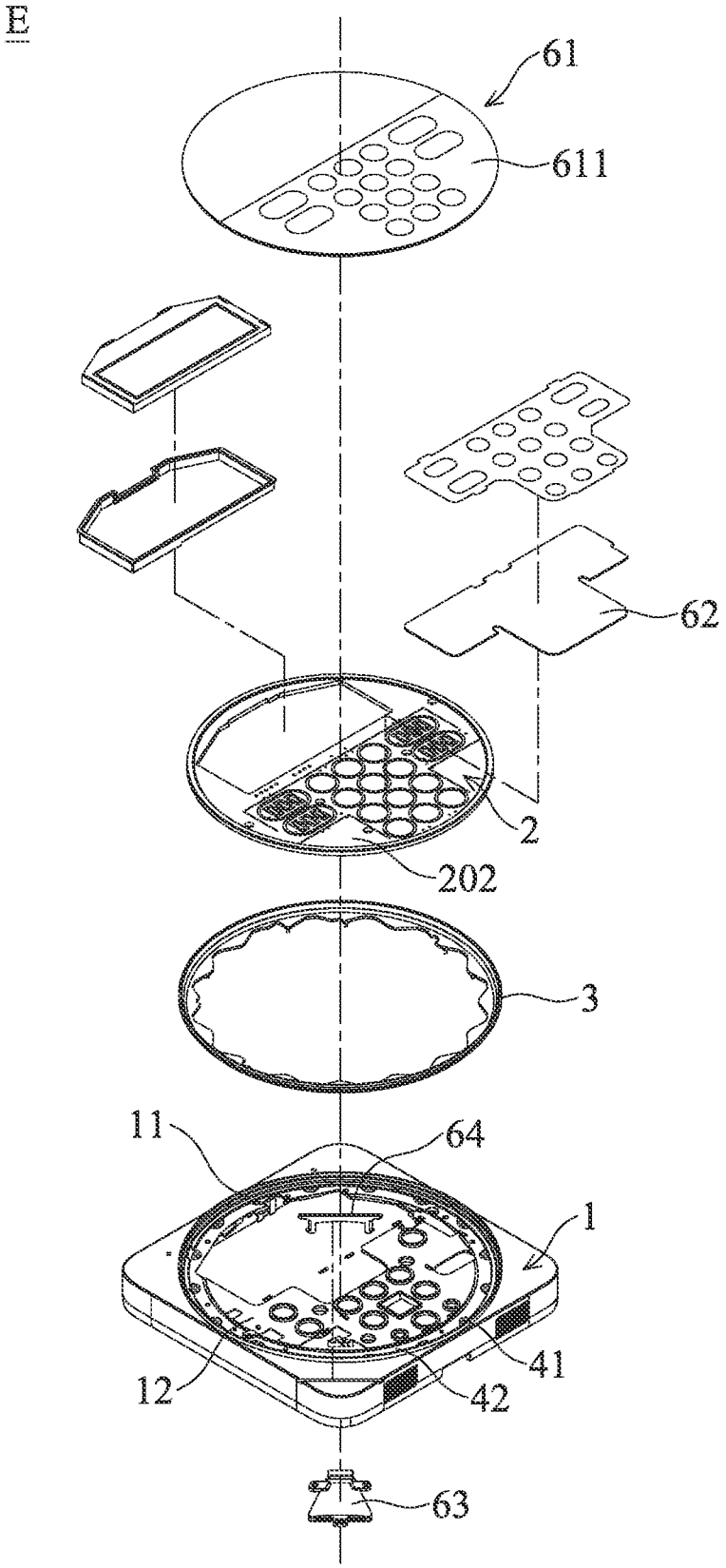
FIG. 2 is an exploded view of the major structure of the electronic device of the embodiment of the invention.

FIG. 1 is a perspective view of an electronic device with light indication functionality of the embodiment of the invention. FIG. 2 is an exploded view of the major structure of the electronic device of the embodiment of the invention. With reference to FIGS. 1 and 2, the electronic device E of the embodiment of the invention includes a device housing 1, a circuit board 2, a guiding ring 3 and a plurality of light-absorbing elements 41. The device housing 1 includes a housing recess 11 and a supporting member 12. The supporting member 12 is formed as the bottom of the housing recess 11. The electronic device can be a wireless transmission device or a wireless remote controller. The disclosure is not meant to restrict the invention.

Figure 3A:
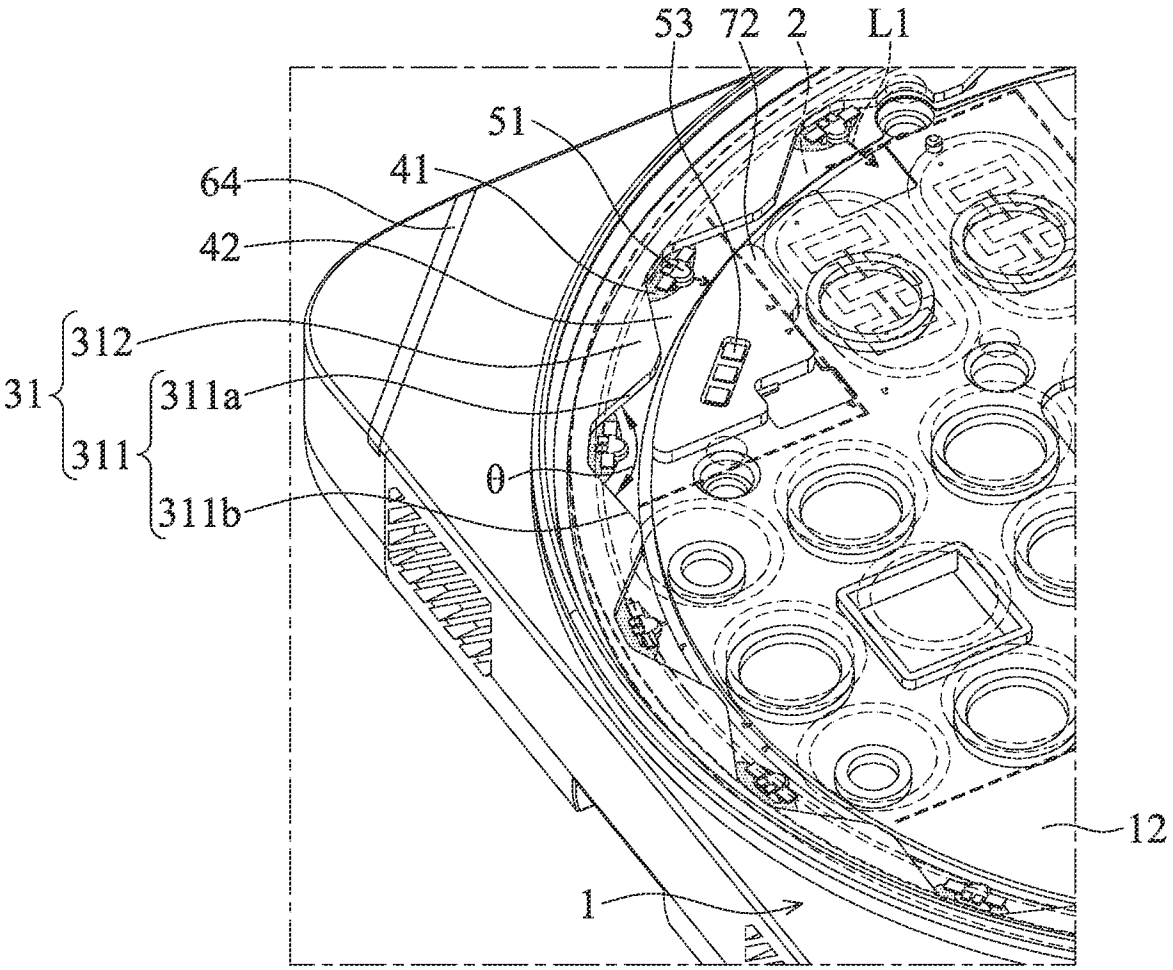
FIG. 3A shows a portion of the electronic device of the embodiment of the invention.
Figure 3B:
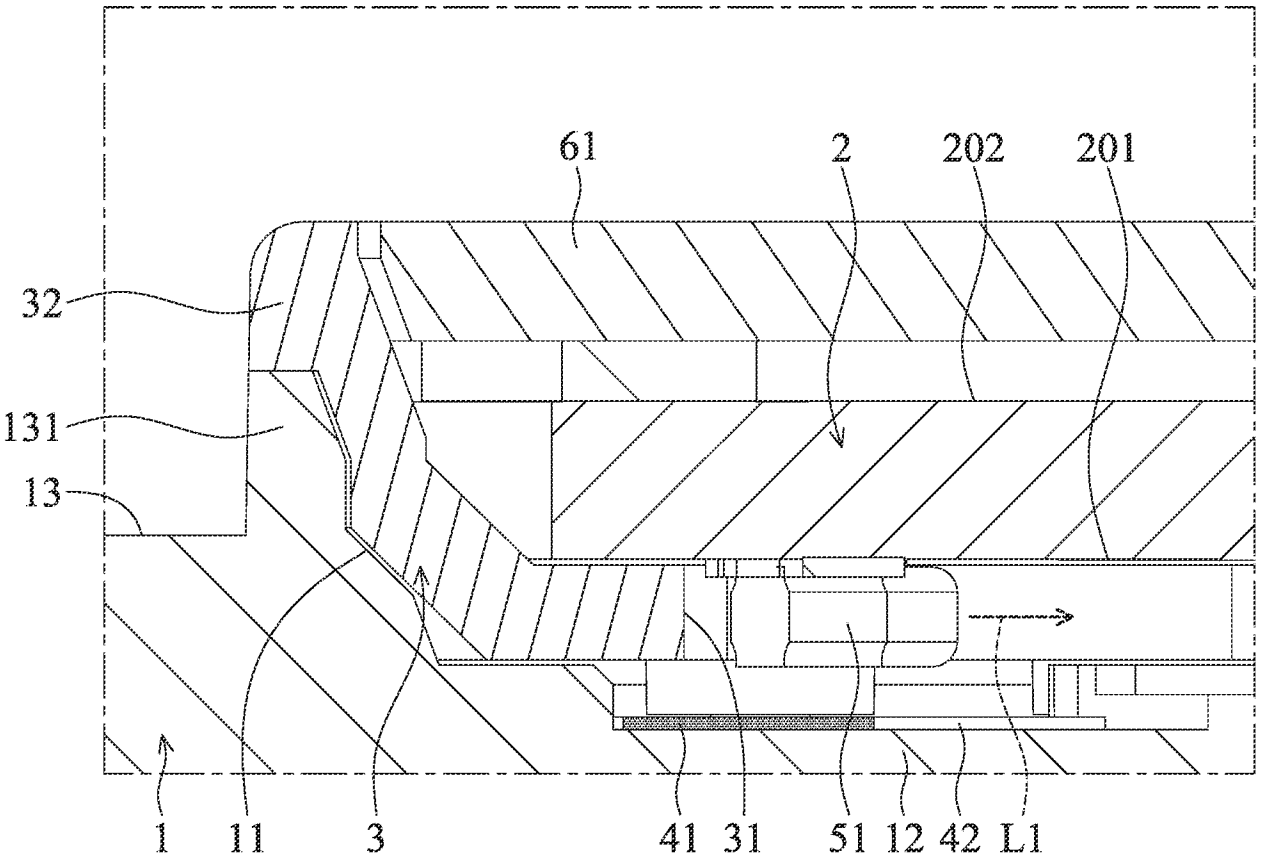
FIG. 3B is a cross sectional view of the electronic device of the embodiment of the invention.

FIG. 3A shows a portion of the electronic device of the embodiment of the invention. FIG. 3B is a cross sectional view of the electronic device of the embodiment of the invention. With reference to FIGS. 2, 3A and 3B, the circuit board 2 is disposed in the housing recess 11. The circuit board 2 comprises a first circuit board surface 201 and a plurality of first light sources 51. The first light sources 51 are disposed on the first circuit board surface 201. The first light sources 51 provide first light beams L1. The guiding ring 3 is disposed on the device housing 1. The guiding ring 3 extends from the housing recess 11 to the exterior of the device housing 1. The guiding ring 3 has a light-entering edge 31 and a light-emitting edge 32. The first light beams L1 enter the guiding ring 3 via the light-entering edge 31, and leave the guiding ring 3 via the light-emitting edge 32. The light-absorbing elements 41 are supported by the supporting member 12 and correspond to the light-entering edge 31.

With reference to FIG. 3B, in one embodiment, at least a portion of the light-entering edge 31 is located between the light-absorbing element 41 and the circuit board 2.

With reference to FIG. 3B, in one embodiment, the device housing 1 comprises a housing outer surface 13 and an annular rib 131. The annular rib 131 is formed on the housing outer surface 13. The light-emitting edge 32 abuts the annular rib 131.

With reference to FIG. 3B, in one embodiment, the electronic device E further comprises a decoration plate 61. The decoration plate 61 covers the circuit board 2. The light-emitting edge 32 surrounds the decoration plate 61.

With reference to FIGS. 2 and 3A, in one embodiment, the light-entering edge 31 comprises a plurality of concave portions 311 and a plurality of convex portions 312. The concave portions 311 and the convex portions 312 are arranged in a staggered manner. The first light sources 51 correspond to the concave portions 311. The light-absorbing elements 41 correspond to the concave portions 311. Particularly, each first light source 51 is partially surrounded by one of the concave portions 311, and each light-absorbing element 41 is below one of the concave portions 311.

With reference to FIG. 3A, in one embodiment, each concave portion 311 has a first sidewall 311*a* and a second sidewall 311*b*. An included angle θ is formed between the first sidewall 311*a* and the second sidewall 311*b*, and the included angle θ is between 100 degrees and 120 degrees.

With reference to FIGS. 2, 3A and 3B, in one embodiment, the electronic device E further comprises a reflective layer 42. At least a portion of each first light source 51 is located between the reflective layer 42 and the circuit board 2. In one embodiment, the light-absorbing elements 41 and the reflective layer 42 are disposed on the supporting member 12. In another embodiment, the light-absorbing elements 41 can be formed by coating the ink on the reflective layer 42 to absorb the light beams. The disclosure is not meant to restrict the invention.

With reference to FIGS. 2, 3A and 3B, in one embodiment, the first light sources 51 are annular arranged. The first light sources 51 face the center of the housing recess 11, and provide the first light beams L1. The first light beams L1 are emitted from the first light sources 51 is the direction away from the guiding ring 3. The first light beams L1 are multiply reflected and scattered between the circuit board 2 and the supporting member 12, and then enter the light-entering edge 31 uniformly, and leave the guiding ring 3 through the light-emitting edge 32.

Figure 4:
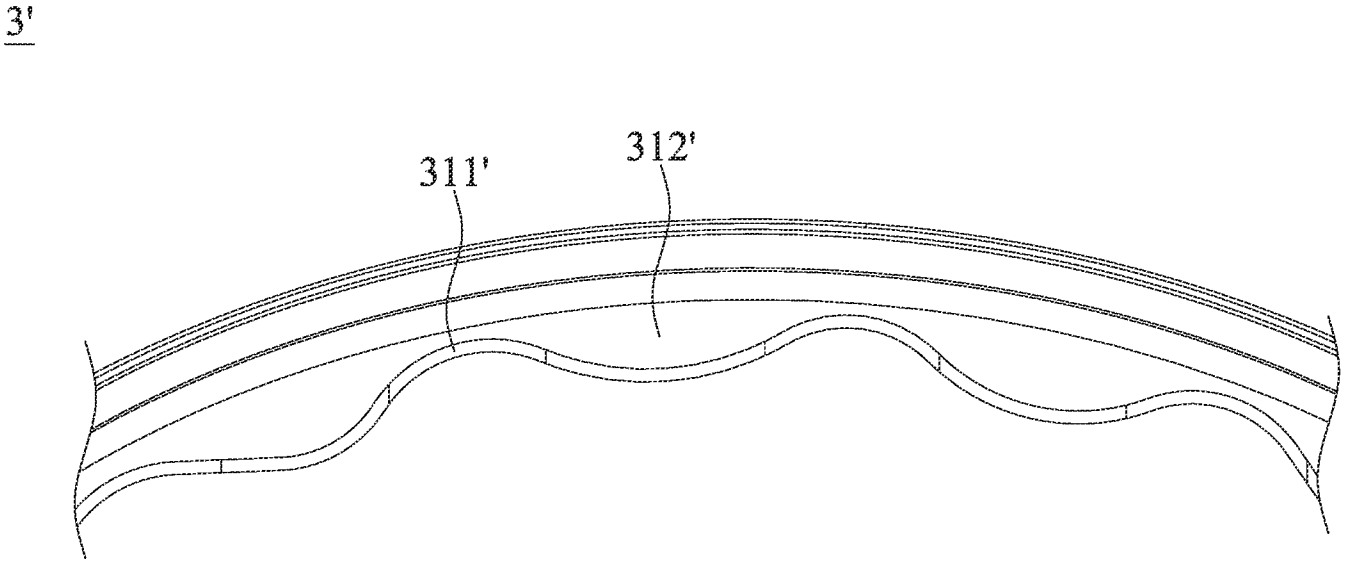
FIG. 4 shows a guiding ring of another embodiment of the invention.

FIG. 4 shows a guiding ring of another embodiment of the invention. With reference to FIG. 4, in this embodiment, the concave portions 311' and the convex portions 312' of the guiding ring 3' are curved.

According to the research of the applicant, the conventional light spot problem of the guiding ring is caused by the location of the reflective layer relative to the light-entering edge. Conventionally, the reflective layer corresponds to the light-entering edge of the guiding ring. In some particular viewing angles, the user can observe the reflective layer. A portion of the light beam reflected by the reflective layer directly passes through the guiding ring and forms the light spot. In the embodiment of the invention, the light-absorbing elements correspond to the light-entering edge of the guiding ring. The light beam is thus prevented from directly passing through the guiding ring after reflected by the reflective layer. The light spots on the guiding ring are reduced.

Figure 5:
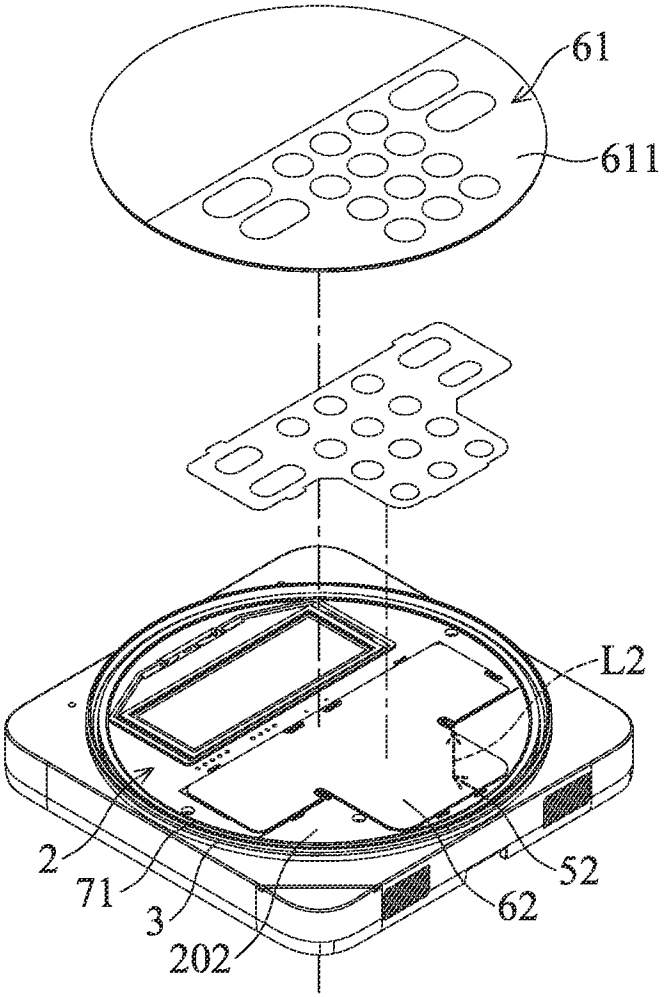
FIG. 5 shows the details of a button light guide of the embodiment of the invention.

FIG. 5 shows the details of a button light guide of the embodiment of the invention. With reference to FIGS. 2 and 5, in one embodiment, the electronic device further comprises a button light guide 62. The decoration plate 61 covers the circuit board 2. The decoration plate 61 comprises a button area 611. The circuit board 2 comprises a second circuit board surface 202 and a plurality of second light sources 52. The second light sources 52 are disposed on the second circuit board surface 202. The second circuit board surface 202 is opposite to the first circuit board surface 201. The button light guide 62 is disposed between the button area 611 and the circuit board 2. The second light sources 52 face the button light guide 62 and provide second light beams L2. The second light beams L2 enter the button light guide 62 and illuminate the button area 611.

With reference to FIG. 5, in one embodiment, the electronic device further comprises a first shielding ring 71. The first shielding ring 71 is disposed on the second circuit board surface 202. The first shielding ring 71 separates the button light guide 62 and the guiding ring 3.

Figure 6:
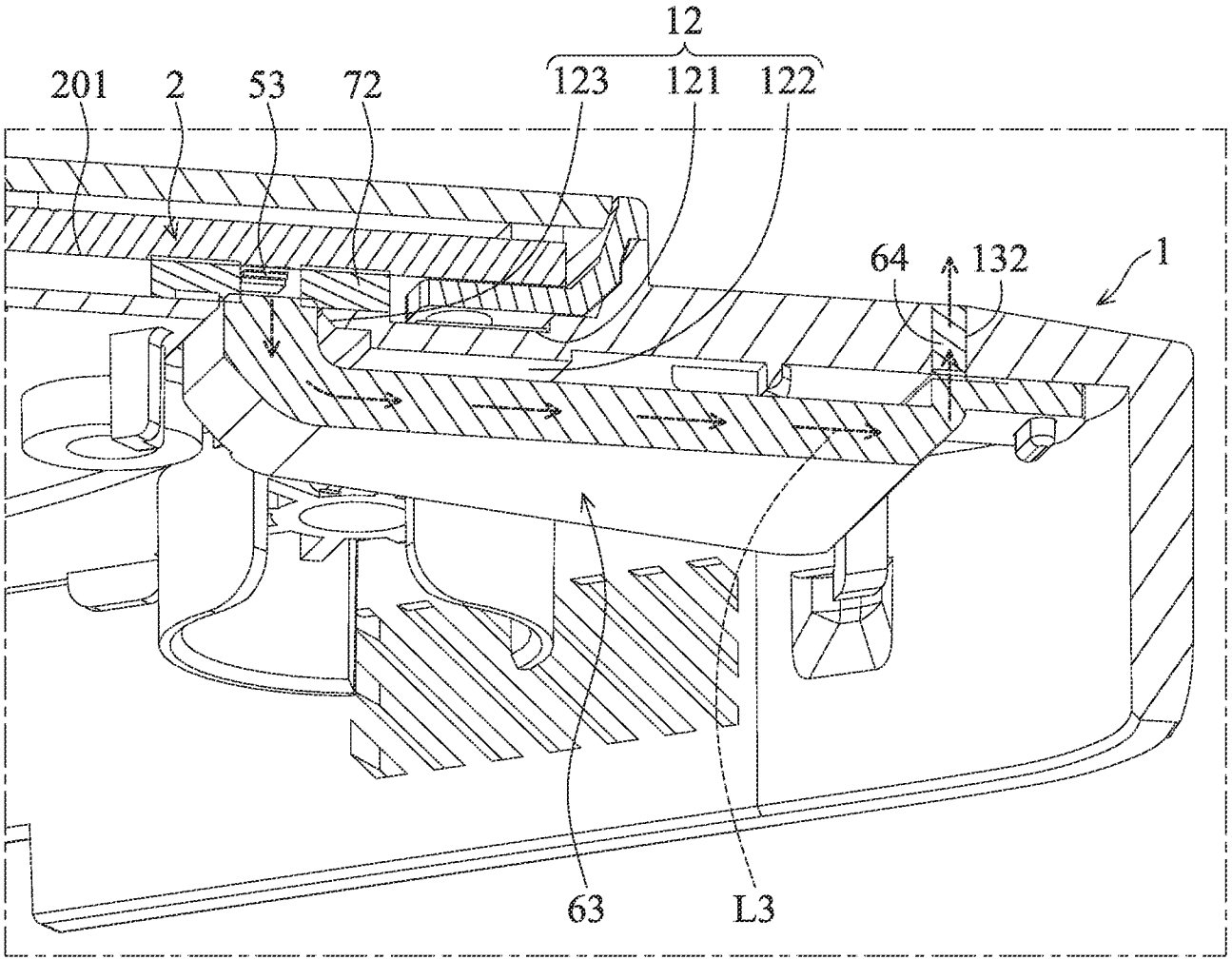
FIG. 6 is another cross sectional view of the electronic device of the embodiment of the invention.

FIG. 6 is another cross sectional view of the electronic device of the embodiment of the invention. With reference to FIGS. 2, 3A and 6, in one embodiment, the electronic device E further comprises at least one third light source 53, a light guiding element 63 and a translucent bar 64. The device housing 1 comprises a housing slot 132. The translucent bar 64 is disposed in the housing slot 132. The third light source 53 provides a third light beam L3. The third light beam L3 passes through the light guiding element 63, and is emitted from the translucent bar 64.

With reference to FIGS. 2, 3A and 6, in one embodiment, the electronic device further comprises a second shielding ring 72. The third light source 53 is disposed on the first circuit board surface 201, and the second shielding ring 72 surrounds the third light source 53.

With reference to FIG. 6, in one embodiment, the supporting member 12 has a member through hole 123, a first member surface 121 and a second member surface 122. The first member surface 121 faces the circuit board 2. The second member surface 122 is opposite to the first member surface 121. The third light source 53 corresponds to the member through hole 123. The light guiding element 63 is disposed on the second member surface 122 and corresponds to the member through hole 123. In this embodiment, the light guiding element 63 is wedged against the second member surface 122. The light guiding element 63 is partially inserted into the member through hole 123.

In the embodiment of the invention, the light-absorbing elements correspond to the light-entering edge of the guiding ring. Therefore, the light beam is prevented from directly passing through the guiding ring after reflected by the reflective layer, the light spots of the guiding ring are reduced, and the visual perception of user is improved. Additionally, the first shielding ring separates the first light beams and the second light beams, and the first light beams are prevented from mixed with the second light beams. The second shielding ring separates the first light beams and the third light beam, and the first light beams are prevented from mixed with the third light beam.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a housing defining a housing recess and having a supporting bottom member;

a circuit board disposed in the housing recess, the circuit board having a first circuit board surface;

a plurality of first light sources disposed on the first circuit board surface, and configured to provide first light beams;

a guiding ring disposed in the housing, and having a light-entering edge and a light-emitting edge, wherein the guiding ring extends from the housing recess to an exterior of the housing, such that the first light beams enter the guiding ring via the light-entering edge, and leave via the light-emitting edge; and a plurality of light-absorbing elements, provided on the supporting bottom member and adjacent to the light-entering edge, wherein the light-entering edge comprises a plurality of concave portions corresponding to the first light sources, and a plurality of convex portions, the concave portions and the convex portions are staggered, and the concave portions also corresponding with the light-absorbing elements.

2. The electronic device as claimed in claim 1, wherein at least a portion of the light-entering edge is located between the light-absorbing element and the circuit board.

3. The electronic device as claimed in claim 1, wherein each concave portion has a first sidewall and a second sidewall defining an included angle therebetween, and the included angle is between 100 degrees and 120 degrees.

4. The electronic device as claimed in claim 1, wherein the housing comprises an outer surface and an annular rib, the annular rib is formed on the outer surface, and the light-emitting edge abuts the annular rib.

5. The electronic device as claimed in claim 4, further comprising a decoration plate covering the circuit board, and the light-emitting edge surrounds the decoration plate.

6. The electronic device as claimed in claim 1, further comprising a reflective layer, wherein at least a portion of each first light source is located between the reflective layer and the circuit board.

7. The electronic device as claimed in claim 6, wherein the first light sources are annular arranged and facing a center of the housing recess.

8. The electronic device as claimed in claim 1, further comprising:

a decoration plate covering the circuit board and having a button area;

a button light guide disposed between the button area and the circuit board;

a second circuit board surface in the circuit board and disposed opposite the first circuit board surface; and a plurality of second light sources disposed on the second circuit board surface to face the button light guide, such that second light beams provided by the second light sources enter the button light guide and illuminate the button area.

9. The electronic device as claimed in claim 8, further comprising a first shielding ring disposed on the second circuit board surface to separate button light guide and the guiding ring.

10. The electronic device as claimed in claim 1, further comprising at least one second light source, a light guiding element and a translucent bar, the housing comprises a housing slot, the translucent bar is disposed in the housing slot, the second light source provides a second light beam, and the second light beam passes through the light guiding element, and is emitted from the translucent bar.

11. The electronic device as claimed in claim 10, further comprising a first shielding ring, wherein the second light source is disposed on the first circuit board surface, and the first shielding ring surrounds the second light source.

12. The electronic device as claimed in claim 11, wherein the supporting bottom member has a member through hole, a first member surface and a second member surface, the first member surface faces the circuit board, the second member surface is opposite to the first member surface, the second light source corresponds to the member through hole, and the light guiding element is disposed on the second member surface and corresponds to the member through hole.

* * * * *